United States Patent [19]

George et al.

[11] Patent Number: 4,697,514

[45] Date of Patent: Oct. 6, 1987

[54] METHOD AND APPARATUS FOR TRANSFERRING INK IN GRAVURE PRINTING

[75] Inventors: Harvey F. George, West Hempstead; Robert H. Oppenheimer, Glen Cove, both of N.Y.

[73] Assignee: Gravure Association of America, New York, N.Y.

[21] Appl. No.: 183,401

[22] Filed: Sep. 2, 1980

Related U.S. Application Data

[63] Continuation of Ser. No. 745,205, Nov. 26, 1976, abandoned, which is a continuation of Ser. No. 247,217, Apr. 24, 1972, abandoned, which is a continuation of Ser. No. 75,731, Sep. 25, 1970, abandoned, which is a continuation of Ser. No. 812,503, Dec. 31, 1968, abandoned, which is a continuation of Ser. No. 493,808, Oct. 7, 1965, abandoned.

[51] Int. Cl.[4] ..... B41F 9/00

[52] U.S. Cl. ..... 101/170; 101/153

[58] Field of Search ..... 101/152, 153, 216, 219, 101/170, DIG. 13, 426

[56] References Cited

U.S. PATENT DOCUMENTS

| | | | |
|---|---|---|---|
| 2,520,504 | 8/1950 | Hooper | 101/219 X |
| 2,558,900 | 7/1951 | Hooper | 101/219 |
| 2,558,901 | 7/1951 | Hooper | 101/219 |
| 2,590,321 | 3/1952 | Huebner | 101/DIG. 13 |
| 2,654,315 | 10/1953 | Huebner | 101/DIG. 13 |
| 2,691,343 | 10/1954 | Huebner | 101/DIG. 13 |
| 2,901,374 | 8/1959 | Gundlach | 101/DIG. 13 |
| 3,295,441 | 1/1967 | Garner | 101/DIG. 13 |

FOREIGN PATENT DOCUMENTS

| | | | |
|---|---|---|---|
| 755486 | 8/1956 | United Kingdom | 101/DIG. 13 |

OTHER PUBLICATIONS

"Electrostatic Transfer of Ink in Gravure Printing", R. H. Oppenheimer et al, Gravure Research Institute Newsletter, No. 14, pp. 11-12, Jul. 1966.

"Electrostatic Transfer of Ink in Gravure Printing", Burt zimmerman et al, Gravure Research Institute Report No. P-16, Project No. PG1-1, pp. 2-3, 19, 21, 22, Nov. 12, 1963.

*Primary Examiner*—J. Reed Fisher

*Attorney, Agent, or Firm*—Parmelee, Bollinger & Bramblett

[57] ABSTRACT

In a gravure printing with liquid ink upon a dielectric surface of a substrate such as paper, transfer to the substrate of a gravure ink having a conductivity of the order of about $5\times10^{-6}$ mho/cm. is improved by creating, at the nip between the gravure cylinder and its impression roll, in the ink in the gravure cells at that nip, a charge whose intensity is sufficient under action by the field to overcome the surface tension forces that normally form a concave meniscus on the ink in those cells so that a portion of the surface of the ink in such cells bulges above the surface of the gravure cylinder and wets the surface of the substrate in contact with the gravure cylinder at that point.

14 Claims, 7 Drawing Figures

Fig. 1.
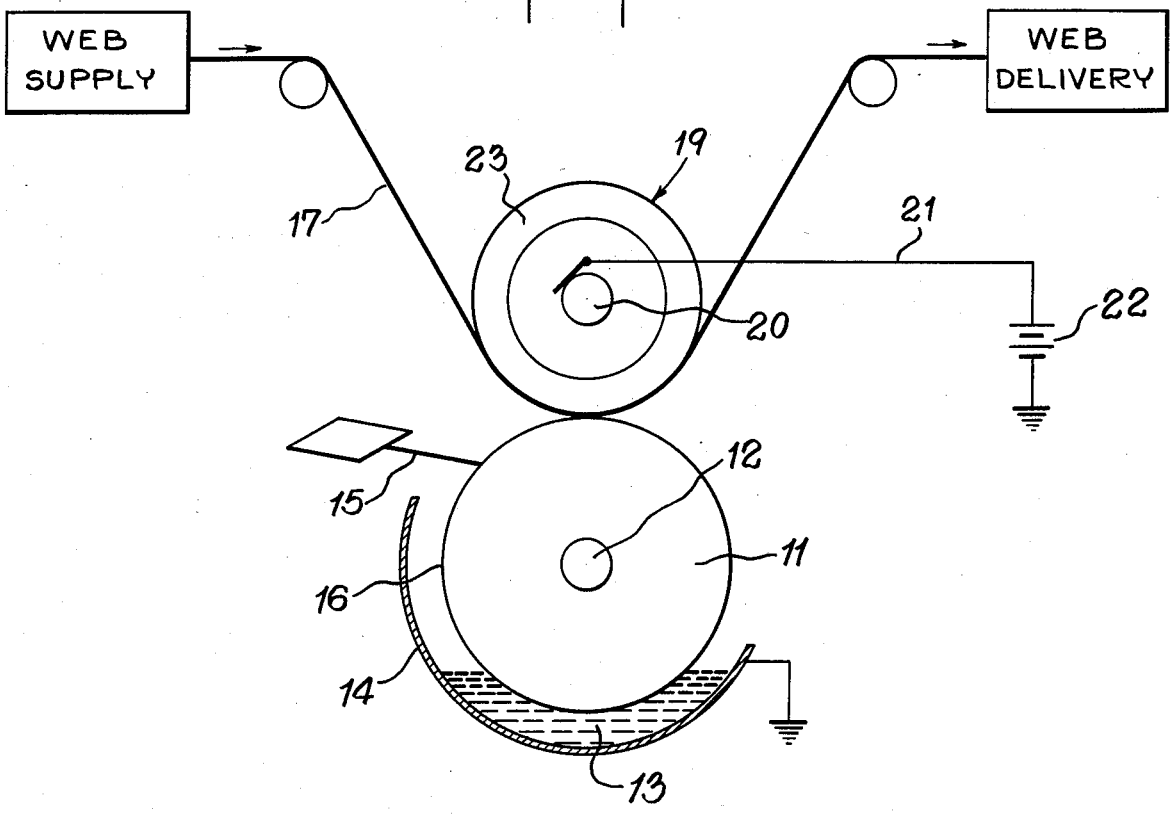
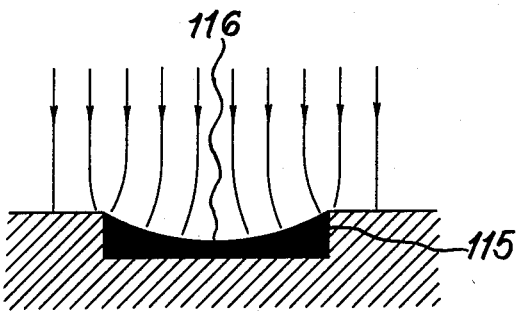
Fig. 6.
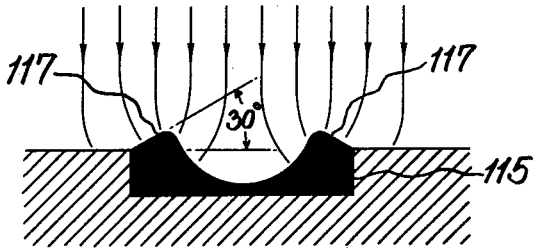
Fig. 7.

45
47'
48
49
47
46

35
37'
38
39
40
37
36
41

25
27
28
29
30
26
31

METHOD AND APPARATUS FOR TRANSFERRING INK IN GRAVURE PRINTING

RELATED APPLICATION

This application is a continuation of co-pending application, Ser. No. 745,205, filed Nov. 26, 1976, now abandoned, which is a continuation of application Ser. No. 247,217, filed Apr. 24, 1972, now abandoned, which is a continuation of application Ser. No. 75,731, filed Sept. 25, 1970, now abandoned, which is a continuation of application Ser. No. 812,503, filed Dec. 31, 1968, now abandoned, which is a continuation of application Ser. No. 493,808, filed Oct. 7, 1965, now abandoned.

BACKGROUND OF THE INVENTION

Gravure printing, as ordinarily practiced in the past, has involved the use of an engraved metal cylinder. The outer surface of that cylinder contains minute cells that form a negative pattern in intaglio of the printed material that is made thereby. Such a gravure cylinder is mounted for rotation about a horizontal axis through an ink fountain where the lowermost segment of the cylinder is immersed in a liquid ink of high fluidity. As the inked portion of the cylinder emerges from the fountain, a doctor blade removes ink from such portions of its peripheral surface as do not contain the minute cells referred to above and these cells then contain ink until it is deposited upon the surface of the substrate. This is accomplished by passing the substrate (e.g., a web of paper) between the gravure cylinder and an impression roll having a resilient rubber covering which presses the lower surface of the substrate against the gravure cylinder so that ink in the cells may be deposited upon that surface. However, in ordinary gravure printing, the ink is not always deposited from all of the cells. The "skipped dots" caused by this result in faulty prints.

Faulty ink transfer has been particularly troublesome when printing upon rough or incompressible stocks. Printers have usually sought to overcome this difficulty by increasing the pressure exerted upon the stock by the impression roll as the stock travels over the surface of the gravure cylinder. But this has resulted in uneven impressions resulting from bending of the gravure cylinder, excess deformation and heat build-up in the rubber impression roll covering, stresses and strains produced in the web, and defective printing in shadow areas. Further difficulties in ordinary gravure printing have resulted from spurious electrostatic charges which are frequently generated on the impression roll and in the web.

SUMMARY OF THE INVENTION

We have discovered that it is possible to improve the transfer of a gravure ink from the cells of a gravure cylinder to the dielectric surface of a substrate by subjecting that ink to the influence of an electric field passing through the portion of the substrate that is located at the nip between the gravure cylinder and the impression roll and generated through the application of an electric charge on the impression roll so that an induced charge is given to the ink in the cells located at the gravure cylinder-impression roll nip. At the same time, the detrimental effects of spurious electrostatic charges on the substrate are suppressed or eliminated. As a result, good print quality may be obtained on stocks that have been regarded as too rough or difficult to print upon gravure. Furthermore, impression pressures may be reduced, thus reducing stresses and strains on the paper and avoiding heat build-up in impression roll coverings with a resultant increase in press speeds and reduction of the frequency of web breaks, and a greater latitude in ink formulation and consistency.

Gravure inks are characterized by their highly fluid nature. The viscosity of such an ink is at most 0.5 poise and the surface of such an ink is easily distorted by relatively small forces.

It has been found that the meniscus of the ink in a gravure cylinder is normally concave. The electrical properties of conventional gravure inks have been found to be such that, as they pass through the nip between the gravure cylinder and the impression roll at the high speeds customarily employed in gravure printing, they can be given an induced charge which is of a sufficiently high level to overcome by a substantial margin the forces that normally cause the concave meniscus referred to above. The resistivity of the inks that may be employed in the practice of our invention may range up to about $2\times10^9$ ohm-centimeters; and they may be formulated through the use of conventional gravure ink solvents, water based inks or polar solvents. Thus, it may be demonstrated, on the basis of theoretical considerations, that, when a gravure ink having electrical properties within the range referred to above, is contained within a typical shadow cell (i.e., a cell whose diameter is about 100 microns and a depth of about 40 microns) in the surface of a grounded gravure cylinder rotating at a printing speed of about 1200 feet per minute, for instance, and a potential is applied to the impression roll, the surface of that ink will have reached 95% of its final charge density in less than 0.3 millisecond from the time of entry into the nip, whereas the time interval available for charging in a nip about ½ inch wide is about 2 milliseconds. In the case of a gravure ink whose conductivity is not less than $0.5\times10^{-9}$ mho/cm., and by virtue of the highly fluid nature of such an ink, it can be caused to bulge from the cells at the nip containing it through the creation of a field.

In the practice of our invention, we employ a gravure ink whose conductivity is preferably about $5\times10^{-6}$ mho/cm. The transfer of such an ink from the cells of a gravure cylinder to the surface of a dielectric substrate is improved by applying an electric field at the nip between the gravure cylinder and an impression roll so that there is impressed on the ink in the cells at said nip an induced charge whose intensity is sufficient to overcome the surface tension forces that normally hold the ink in those cells with a concave meniscus.

It is a particular feature of our invention that, not only can it be practiced with a gravure ink of a conventional formulation, but existing gravure presses can be readily modified to incorporate our invention at moderate cost. The apparatus that we employ in the practice of our invention consists of a printing press of the class in which an impression roll urges the surface of a dielectric substrate against a gravure cylinder bearing inked cells in its surface. The parts of that printing press, other than the impression roll, may in general be of conventional construction, it being merely necessary that the gravure cylinder is at ground potential, and, if a back-up cylinder is used it should have suitable insulations. The impression roll that we employ in such a press is adapted to receive an electric charge which creates an electric field across the dielectric substrate at the nip between the gravure cylinder and the impression roll, and means are provided for continuously applying to that impression roll while it is in operation an electric charge whose potential is sufficiently high to create, on ink in the cells at the gravure cylinder-impression roll nip, an induced charge of a magnitude that overcomes the forces that normally hold the ink in these cells with a concave meniscus.

BRIEF DESCRIPTION OF THE DRAWING

In order that the practice of our invention will be clearly understood by those skilled in the art, we will describe the specific embodiment thereof that we now prefer and which is illustrated schematically in the accompanying drawings wherein:

FIG. 1 is an end elevation of a gravure press unit embodying our invention;

FIG. 6 is a transverse section, greatly magnified, of one of the cells engraved in the surface of a gravure cylinder and containing ink with a normally concave meniscus; and FIG. 7 is a view similar to FIG. 6 but showing our concept of the shape assumed by the surface of the ink in the gravure cell under the influence of an induced electric charge pursuant to our invention.

DESCRIPTION OF THE PREFERRED EMBODIMENT

Figure 2:
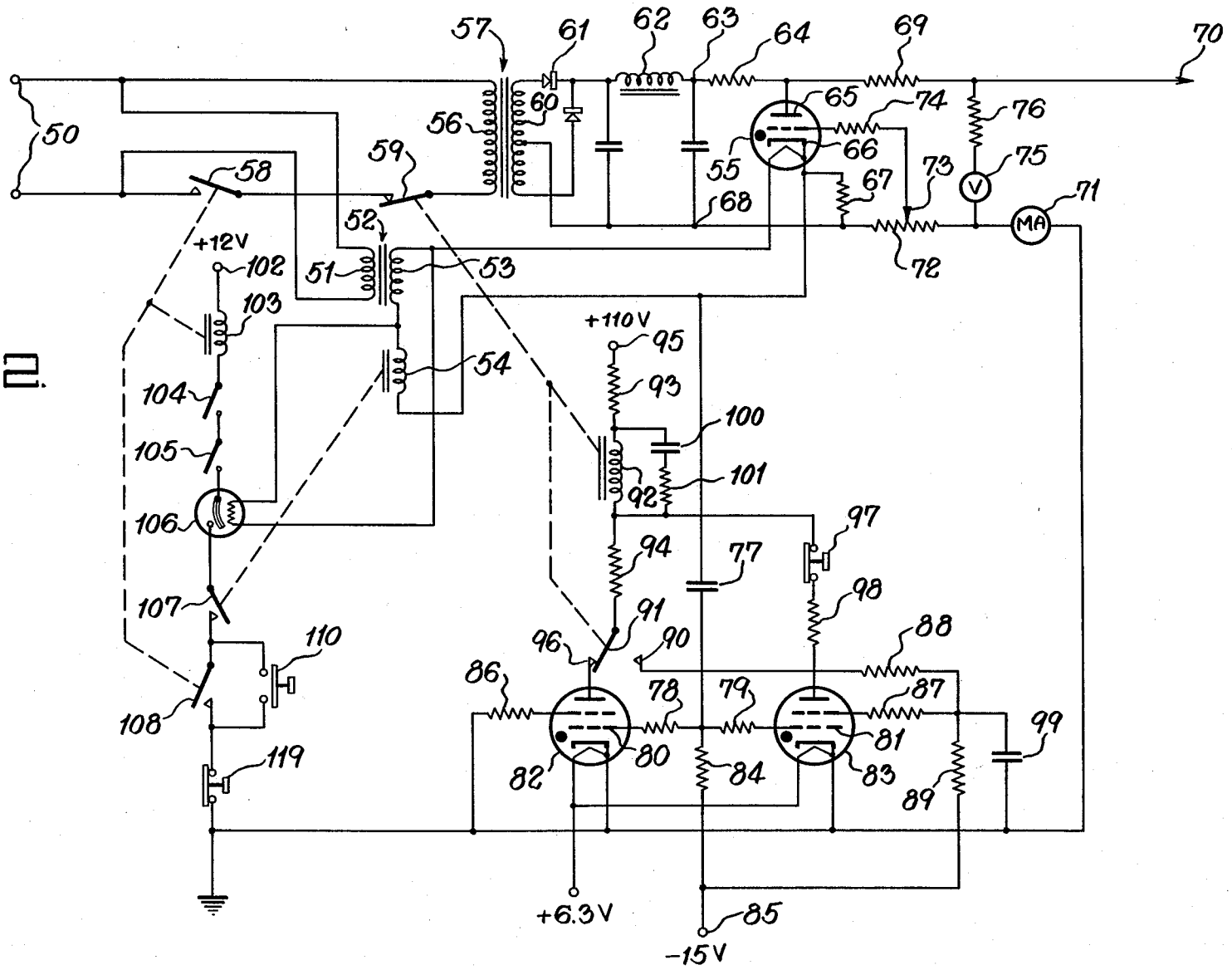
FIG. 2 is a schematic diagram of the electric circuit for charging the impression roll illustrated in FIG. 1.

The gravure printing press unit that is illustrated in FIG. 1 of the drawing is, in the main, of conventional construction. It includes a grounded gravure cylinder 11 that is mounted for rotation about a horizontal axis 12 so that its segment dips into the ink 13 that is contained in fountain 14. A doctor blade 15 wipes ink off the peripheral surface 16 of cylinder 11 as it emerges from the fountain. A web 17 of paper is fed from a web supply to a web delivery such as a second printing unit or a folder so that its lower surface is pressed against the upper surface of the gravure cylinder 11 by means of an impression roll 19.

The impression roll 19 has an inner core 20 of metal that is insulated from ground and is connected, as by means of brush 21, to the output of a high voltage power supply 22. The core 20 is covered with a layer 23 of a resilient semi-conducting rubber. It is known that the electrical properties of rubber can be modified by incorporating therein particles of a conductor such as carbon black. The rubber that we employ in the formation of the layer 23 is modified so that its conductivity is of the order of about $10^{-5}$ to about $10^{-8}$ mho/cm., and the term "semi-conducting" as used herein refers to such a rubber.

Figures 3, 4, 5:
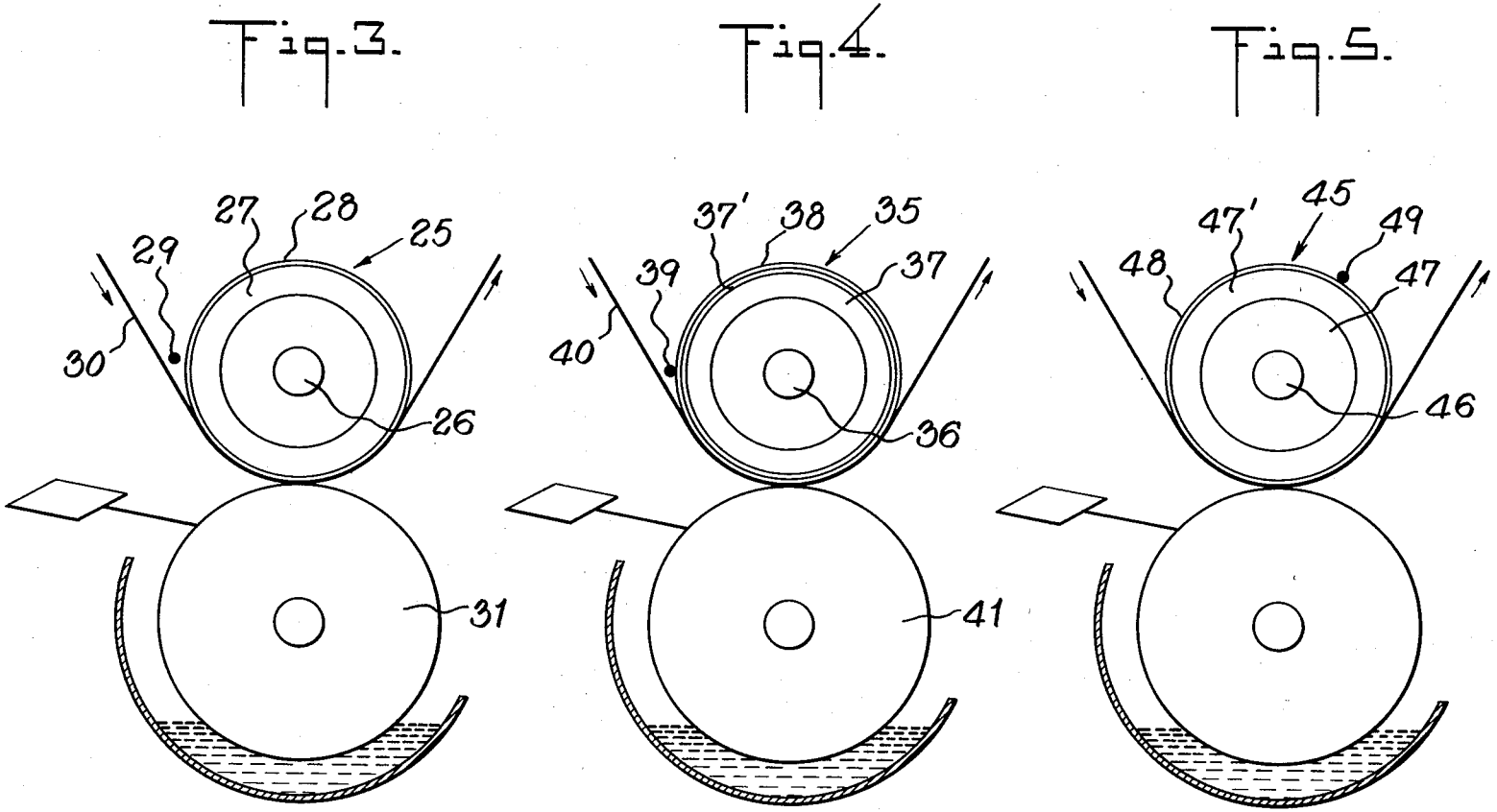
FIG. 3 is an end elevation of a modified form of impression roll and charging means therefor.
FIG. 4 is an end elevation of a modified impression roll of the type illustrated in FIG. 3 and charging means transfer.
FIG. 5 is an end elevation of another form of impression roll and charging means therefor.

Each of the impression rolls illustrated in FIGS. 3 and 4 includes a grounded cylinder made of an electrically conductive material whose outer peripheral surface is coated with a thin layer of an insulating material such as Teflon or polyurethane and which has associated therewith charging means located adjacent the point where the dielectric substrate to be printed upon first contacts the impression roll before it enters the nip between that impression roll and its gravure cylinder. This construction permits charging of the impression roll before entry into the nip between that roll and its associated gravure cylinder. The thin insulating layer backed by a grounded conductor provides high capacitance per unit area from the region of charge application to the nip and prevents an excessive voltage drop on entry into the nip where the close proximity of the highly conductive gravure cylinder raises the capacitance per unit area.

The impression roll 25 (FIG. 3) is mounted for rotation about horizontal axis 26 that supports the grounded cylinder 27 of conductive resilient rubber which is coated with a thin layer 28 of insulating material. Charge is applied to the insulating surface of impression roll 25 by means of a corona charging device of conventional construction which, as illustrated, includes a corona wire 29 connected with a high voltage supply (not shown) and extending along but spaced from the outer surface of impression roll 25 at a location that is adjacent the point where the web 30 first contacts the impression roll before it enters the nip between impression roll 25 and the gravure cylinder 31.

The impression roll 35 (FIG. 4) is mounted for rotation about horizontal axis 36 that supports the cylinder 37 of resilient rubber that is coated with a thin grounded layer 37' of conductive silver lacquer and which, in turn, is coated with a thin layer 38 of insulating material. Charge is applied to impression roll 35 by means of a series of contacts 39 connected with a high voltage supply (not shown) and extending along the outer surface of impression roll 35 at a location that is adjacent the point wherein the web 40 first contacts the impression roll 35 preceding its entry into the nip between the impression roll 35 and the gravure cylinder 41.

The impression roll 45 illustrated in FIG. 5 is mounted for rotation about a horizontal axis 46 and including a metal core 47 and a layer 47' of resilient rubber which is provided with a coating 48 of a conductive material such as silver paint. Charge is applied to the coating 48 from a high voltage supply (not shown) through contacts 49.

The high voltage power supply 22 of FIG. 1 is illustrated schematically in FIG. 2 to which attention is now directed. A pair of terminals 50 coupled to a 115 volt, 60 cycle source (not shown) is connected to the primary winding 51 of a filament transformer 52. Transformer 52 has a secondary winding 53 which is connected in series with a relay winding 54 to the filament of a positive control grid Thyratron 55. Terminals 50 are also connected to the primary winding 56 of a power transformer 57. The connection to the winding 56 includes the normally open relay contacts 58 and the normally closed relay contacts 59.

The transformer 57 is provided with a center tapped secondary winding 60 to which is connected a full wave rectifier circuit 61 and a filter network 62. The positive output terminal 63 of the filter 62 is connected through a plate resistor 64 to the anode 65 of the Thyratron 55. The cathode 66 of the Thyratron is connected through a cathode resistor 67 to the negative side 68 of the filter. A current limiting resistor 69 connects the plate 65 of the Thyratron to an output terminal 70 which can be connected to the brush 21 in FIG. 1.

It was mentioned above that the gravure cylinder 11 in FIG. 1 is grounded. As seen in FIG. 2, the circuit is completed by a connection from ground through a milliammeter 71 and a potentiometer 72 to the negative terminal 68 of the filter 62. The adjustable contact 73 on the potentiometer 72 is connected through a current limiting resistor 74 to the control grid of the Thyratron 55.

If desired, a voltmeter 75 may be connected in series with a scaling resistor 76 between the high voltage terminal 70 and the junction between the milliameter 71 and the potentiometer 72, as shown.

The cathode 66 of the Thyratron 55 is connected through a coupling capacitor 77 and current limiting resistors 78 and 79 to the control grids 80 and 81, respectively, or shield grid Thyratrons 82 and 83. Cut-off bias for the control grids of the Thyratrons 82 and 83 is provided by connecting the junction between resistors 78 and 79 through a grid resistor 84 to a terminal 85 which is connected to a minus 15-volt source (not shown). The cathodes of Thyratrons 82 and 83 are connected to ground. The shield grid of Thyratron 82 is connected through a current limiting resistor 86 to ground. The shield grid of Thyratron 83 is connected through a current limiting resistor 87 to a voltage divider network consisting of resistors 88 and 89. The free end of resistor 89 is connected to the minus 15-volt source at terminal 85. The free end of resistor 88 is connected to a fixed contact 90 associated with movable contact 91 under the control of relay winding 92. The relay winding 92 is connected in series with resistors 93 and 94 between a terminal 95 and the relay contact 91. Terminal 95 is connected to a positive 110-volt source (not shown).

Relay contact 91 normally engages fixed contact 96 which is connected to the plate or anode of Thyratron 82. The junction between the relay winding 92 and resistor 94 is connected through a normally closed manually operably switch 97 and a current limiting resistor 98 to the anode of Thyratron 83. A condenser 99 connects the common junction of resistors 87, 88 and 89 to ground, as shown. A condenser 100 and resistor 101 are connected in series across the winding 92.

A terminal 102 connected to a positive 12-volt supply (not shown) is connected in series with a relay winding 103 to a first interlock switch 104 and a second interlock switch 105. From switch 105 the circuit continues in series fashion through the normally open contacts of a thermal-control time delay switch 106, the normally open contacts 107 of relay 54, the normally open contacts 108 of relay 103 and the normally closed manually operable switch 119 to ground. Connected in shunt with the contacts 108 is a normally open manually operable switch 110. The heating element for the switch 106 is connected in parallel with the secondary winding 53 of filament transformer 52.

The interlock switch 104 may be connected to the drive motor for the press so that it will be closed when, and only when, the press is running at full production speed. This can be accomplished in any known manner.

Switch 105 is connected to the mechanism which positions the impression roll against the gravure cylinder such that it is closed only when impression pressure is applied.

All of the contacts and switches in FIG. 2 are shown in the condition which prevails when the system is fully deenergized. The voltages shown applied to terminals 50, 85, 95 and 102 are obtained from power supplies in known manner. These power supplies will be turned on when it is desired to apply high voltage to the impression roll. As soon as voltage appears at the terminals 50, filament current will be supplied to the Thyratron 55. By separate means (not shown) filament voltage will also be supplied in known manner to the Thyratron 82 and 83. As soon as transformer 52 is energized it will supply voltage to the heater of thermal switch 106 and will cause the relay 54 to operate. This will result in closure of contacts 107 immediately and at some later time closure of the thermal switch 106. Assuming that the press is at operating speed and that the impression roll is in operating position the switches 104 and 105 will also be closed. Hence, as soon as manually operable switch 110 is closed a circuit will be completed through the relay winding 103. This will cause closure of relay contacts 58 and 108.

It will be seen that contacts 108 act as holding contacts for relay 103. Closure of contacts 58 will complete the circuit to the transformer 57. This will apply the high voltage, for example, 700 volts, to the terminal 70. Assuming satisfactory operation of the press with a proper web between the gravure cylinder and the impression roll, insufficient current will flow through the circuit and through potentiometer 72 to raise the control grid of Thyratron 55 to its ignition potential. If necessary, the slider 73 can be adjusted appropriately.

If due to an imperfection in the web or for other reasons excessive current should tend to flow between the impression roll and the gravure cylinder Thyratron 55 will be triggered by the increased voltage drop across the potentiometer 72. This will immediately drop the voltage between terminal 70 and ground. In addition, the current now flowing through cathode resistor 67 will cause a positive going voltage pulse to be applied through capacitor 77 to the control grids 80 and 81 of Thyratrons 82 and 83. Tube 83 is maintained cut-off by the negative bias on its shield grid. However, the tube 82 will be triggered.

When Thyratron 82 conducts it causes current to flow through relay winding 92. This results immediately in interruption of the circuit to transformer 57 by opening contacts 59. In addition, contact 91 is moved from engagement with fixed contact 96 into engagement with fixed contact 90. The plate circuit to Thyratron 82 having been interrupted, this tube is extinguished. But, current contiues to flow through relay winding 92 and resistor 88 to place a positive charge on capacitor 99. However, the time constant of capacitor 77 and resistor 84 is such that the positive pulse on control grid 81 has decayed before the voltage on the shield grid of tube 83 exceeds the cut-off point. Hence, tube 83 remains extinguished. The energization of the winding 92 is prolonged by the capacitor 100 and resistor 101 connected in shunt thereto. This insures that sufficient charge is placed upon capacitor 99 to raise the voltage on the shield grid of tube 83 above its cut-off point.

When contacts 59 are opened removing voltage from transformer 57, the high voltage at terminal 70 is removed completely. Also as a consequence, the Thyratron 55 is extinguished.

After a predetermined delay the relay winding 92 becomes de-energized causing contact 91 to return to fixed contact 96, and contacts 59 to re-close. This restores the high voltage to terminal 70. If a fault still exists the Thyratron 55 will fire again. A positive going pulse will be supplied through capacitor 77 to the control grid of Thyratrons 82 and 83. Thus, when relay 92 is energized, a holding circuit remains through Thyratron 83. Consequently, the contacts 59 remain open and the high voltage at terminal 70 is not restored until the circuit is re-set manually by actuation of switch 97 to interrupt the plate voltage on Thyratron 83.

It will be seen, however, that if the fault was of brief duration such that it disappears before Thyratron 55 becomes triggered for the second time, the circuit will resume functioning without further interruption. After a brief interval the charge on capacitor 99 will decay so as to restore the cirucit to its original standby condition.

When it is desired to shut down the electric circuit, switch 119 is actuated to release relay 103, and the power supplies are turned off.

It will be understood that the time delay switch 106 is provided to enable the filament winding of Thyratron 55 to be brought up to operating temperature before plate voltage is applied. The power supplies would be provided with a similar arrangement in known manner for protecting Thyratrons 82 and 83.

The operation of a gravure printing press equipped with an impression roll and charging circuit therefor, such as we have described, is as follows:

After the web 17 of paper is threaded between the gravure cylinder 11 and the impression roll 19, and the desired impression pressure is applied, the gravure cylinder is brought to printing speed. Then, when the main switch 110 is closed manually, the circuit to transformer 57 is completed and it will apply the necessary high voltage to the brush 21 and inner core 22 of impression roll 19, thus creating an electric field which passes through the paper 17 located in the nip between cylinder 11 and roll 19.

As the lower segment of gravure cylinder 11 emerges from the ink 13 that is contained in fountain 14, ink is retained in the minute cells in the surface of the gravure cylinder. Such a cell, designated by the number 115, is illustrated in greatly enlarged form in FIGS. 6 and 7 and it will be assumed for purpose of illustration that cell 115 is a circular cell having a diameter of 0.01 cm. The ink in cell 115 normally has a concave meniscus 116 and as gravity and centrifugal forces acting on the small ink volume in such a cell can be neglected, the ink meniscus 116 in cell 115 must be initially of uniform curvature, i.e., part of a sphere. As cell 115 enters the nip between gravure cylinder 11 and impression roll 19, the influence of the electric field passing through the portion of web 17 that is located at that nip gives an induced charge to the ink in cell 115 of such magnitude that the forces normally causing the ink meniscus to assume a concave form are overcome. As a result of the nature of the curvature of the concave meniscus 116 illustrated in FIG. 6, the electrostatic pull will be highest close to the edges of cell 115 and the ink meniscus will begin to deform as illustrated in FIG. 7, with the electrostatic forces concentrated on the bulge 117 around the outer edge of the ink in cell 115. This deformation is opposed by the surface tension of the ink and we believe that a critical poit is probably reached when the angle between the ink meniscus and the surface of the gravure cylinder is about 30°. Thus, forces that tend to hold the ink in a gravure cell in the form of a concave meniscus are overcome in that portion of the cells that are located on the surface of the gravure cylinder that is in contact with web 17. As skipped or missed cells are believed to be caused primarily by faulty contact between the ink in the cells and the surface of the substrate, the deformation of the surface of the ink in the gravure cells that is accomplished through the practice of our invention makes it possible to produce superior prints at normal or reduced pressure.

The terms that we have used in describing the preferred embodiment of our invention that is illustrated in the accompanying drawings are terms of description and not of limitation, and it is to be understood that the apparatus that we have described may be modified in various ways without departing from the spirit of our invention as it is defined in the appended claims.

We claim:

1. In gravure printing with highly fluid liquid ink, a method for eliminating skipped dots, which result from inadequate transfer of the highly fluid liquid ink present in gravure printing cells of a rotating gravure printing cylinder onto the surface of a dielectric substrate due to roughness and depressions in the surface of the dielectric substrate, by increasing the accessibility to the highly fluid liquid ink in the gravure printing cells at the printing nip and thereby improve the print quality of the ink deposited upon the surface of the dielectric substrate, comprising the steps of:

urging the dielectric substrate into substantial pressure contact with the rotating gravure printing cylinder by means of an impression roll backing the dielectric substrate, the substantial pressure contact occurring at the printing nip between the gravure printing cylinder and the impression roll;

generating a controlled electric field at the printing nip between the gravure printing cylinder and the impression roll;

inducing a controlled charge on the highly fluid liquid ink present in the gravure printing cells at the printing nip as a result of the presence of the controlled electric field, the elecrostatic forces resulting from the induced charge and controlled electric field being sufficient to overcome the surface tension forces which normally hold the highly fluid liquid ink in the gravure printing cells with a concave meniscus and thereby distort the normal concave surface to provide a bulging in the surface of the ink adjacent the boundary walls of the gravure printing cells so that the surface of highly liquid fluid ink extends above the peripheral surface of the gravure printing cylinder while the highly fluid liquid ink maintains continuity in its configuration in the gravure printing cells to provide improved contact between the surface of the highly fluid liquid ink and the depressed areas in the surface of the dielectric substrate so that the highly fluid liquid ink more readily contacts those portions in the surface of the dielectric substrate which would normally not be reached by the configuration of the highly fluid liquid ink present in the gravure cells of conventional gravure printing cylinders.

2. The method recited in claim 1, wherein:

the resistivity of the highly fluid liquid ink has a maximum value of $2\times10^9$ ohn cm.

3. The method recited in claim 1, including the steps of:

applying a voltage to the impression roll to generate the controlled electric field;

automatically removing the voltage applied to the impression roll upon the detection of a predetermined current flow between the impression roll and the gravure printing cylinder.

4. The method recited in claim 1 wherein:

the value of the controlled electric field is such that the angle between the bulging portion of the highly fluid liquid ink and the peripheral surface of the gravure printing cylinder is about 30°.

5. The method recited in claim 1, wherein:

the controlled induced charge on the highly fluid liquid ink will reach approximately 95% of its final charge in less than about 0.3 milliseconds.

6. The method recited in claim 1, wherein:

the controlled electric field is generated by applying a voltage of approximately 700 volts to the impression roll.

7. A gravure printing press of the type in which the surface of a dielectric material is pressed by an impression roll against a gravure printing cylinder which includes gravure printing cells with highly fluid liquid ink therein for transfer to the surface of the dielectric material at the printing nip between the impression roll and the gravure printing cylinder, wherein the improvement comprises:

charging means including an impression roll having conductive core and a layer of resilient semi-conducting material with a conductivity from about $10^{-5}$ to about $10^{-8}$ mho/cm for generating a controlled electric field at the printing nip and for inducing a controlled electric charge on the highly fluid liquid ink present in gravure printing cells at the printing nip, the electrostatic forces resulting from the controlled electric field and induced controlled electric charge being sufficient to overcome the surface tension forces which normally hold the highly fluid liquid ink in the gravure printing cells with a concave meniscus to distort the surface of the highly fluid liquid ink to effect a bulging in the surface of the ink adjacent the boundary walls of the gravure printing cells beyond the peripheral surface of the gravure printing cylinder while maintaining continuity in the surface of the highly fluid liquid ink in the gravure printing cells, so that the highly fluid liquid ink more readily contacts the surface of the dielectric substrate to improve the print quality of the highly fluid liquid ink deposited on the surface of the dielectric substrate from gravure printing cells which would otherwise skip because of roughness and depressions in the surface of the dielectric substrate;

circuit means for interrupting the controlled electric field upon detection of a predetermined current flow across the printing nip;

holding circuit means for automatically reestablishing the controlled electric field if the predetermined current flow is absent across the printing nip after a predetermined time interval.

8. The gravure printing press recited in claim 7, wherein:

said conductive core is electrically isolated from ground and a brush is coupled between said voltage source and said conductive core to applyy voltage to said impression roll.

9. The gravure printing press recited in claim 7, wherein:

said charging means for generating an electric field includes a series of contacts connected to a voltage source, said contacts being positioned in contact with the outer surface of said impression roll adjacent the point where the dielectric material first contacts the impression roll before it enters the printing nip.

10. The gravure printing press recited in claim 7, wherein:

said impression roll has an outer insulating layer.

11. The gravure printing press recited in claim 10, wherein:

said charging means includes means spaced adjacent the outer surface of the impression roll and adjacent the point where the dielectric material first contacts the impression roll before it enters the printing nip.

12. The gravure printing press recited in claim 7, wherein:

said charging means includes a corona charging means spaced adjacent the outer surface of said impression roll and adjacent the point where the dielectric material first contacts said impression roll before it enters the printing nip, 13. The gravure printing press recited in claim 7, wherein:

said charging means includes voltage meas for applying a voltage of approximately 700 volts to said impression roll.

14. The gravure printing press recited in claim 7, wherein:

said impression roll includes a conductive outer covering;

said charging means includes contacts which abut the outer conductive covering at points spaced from the nip.

* * * * *